US007942294B2

(12) United States Patent
Burton et al.

(10) Patent No.: US 7,942,294 B2
(45) Date of Patent: May 17, 2011

(54) MACHINE AND PROCESS FOR PERSONAL, SIDE MOUNTED BIOMECHANICALLY ENGINEERED LIFTING DEVICE; A DEVICE FOR LIFTING AWKWARD AND HEAVY LOADS

(76) Inventors: Alan Clifford Burton, Greenfield Center, NY (US); John Joseph Cunningham, Saratoga Springs, NY (US)

( * ) Notice: Subject to any disclaimer, the term of this patent is extended or adjusted under 35 U.S.C. 154(b) by 441 days.

(21) Appl. No.: 12/152,357

(22) Filed: May 15, 2008

(65) Prior Publication Data

US 2009/0283560 A1 Nov. 19, 2009

(51) Int. Cl.
*A45F 3/14* (2006.01)

(52) U.S. Cl. ..... 224/257; 224/250; 224/162

(58) Field of Classification Search ..... 224/925, 224/257, 258, 157, 184, 162, 149, 153, 156, 224/158, 259, 260, 600, 625, 264; 119/796, 119/770; 294/150; *A45F 3/14*
See application file for complete search history.

(56) References Cited

U.S. PATENT DOCUMENTS

| | | | | | |
|---|---|---|---|---|---|
| 2,533,135 | A | * | 12/1950 | McKenzie | 224/257 |
| 2,651,441 | A | * | 9/1953 | Rau et al. | 224/259 |
| 3,181,752 | A | | 5/1965 | Seltzer et al. | |
| 3,357,613 | A | * | 12/1967 | Chase | 224/162 |
| 4,280,645 | A | | 7/1981 | Goodden | |
| 4,308,629 | A | * | 1/1982 | Freemon | 441/111 |
| 4,804,025 | A | * | 2/1989 | Bear | 224/604 |
| 4,887,752 | A | * | 12/1989 | Nauta | 224/621 |
| 4,977,860 | A | * | 12/1990 | Harwell | 119/794 |
| 6,378,746 | B1 | * | 4/2002 | Miller | 224/258 |
| 6,508,389 | B1 | | 1/2003 | Ripoyla et al. | |
| 7,458,488 | B2 | * | 12/2008 | Bass et al. | 224/162 |
| 2002/0008125 | A1 | * | 1/2002 | Caputi | 224/257 |
| 2006/0108387 | A1 | * | 5/2006 | Nakaya et al. | 224/254 |
| 2007/0023469 | A1 | * | 2/2007 | Nightingale | 224/625 |
| 2007/0157424 | A1 | * | 7/2007 | Mottahedeh | 15/405 |
| 2007/0205236 | A1 | * | 9/2007 | Partusch | 224/250 |

FOREIGN PATENT DOCUMENTS

| | | | | |
|---|---|---|---|---|
| FR | 2700930 | A1 | * | 8/1994 |
| JP | 2008104841 | A | * | 5/2008 |

* cited by examiner

*Primary Examiner* — Justin M Larson

(57) ABSTRACT

The side-mounted, biomechanically designed lifting device maximizes the lifting capability of human anatomy. A harness with a shoulder pad crosses the user's body diagonally. The load is supported by an adjustable load strap at the user's side from a support ring attached to the harness. One end of the support strap is attached to the harness and the other to a lifting handle. With this device and method heavy and awkward loads like plywood and drywall may be carried and manipulated easily. The side-mounted lifting harness causes the user to lean away from the load. This transfers the weight of a load to a point near the ground, below the vertical center of gravity of the user and between the lifter's feet. There is significant biomechanical advantage to this load configuration. One person can carry heavy, awkward loads safely and quickly with a minimum of physical stress.

4 Claims, 7 Drawing Sheets

MACHINE AND PROCESS FOR PERSONAL, SIDE MOUNTED BIOMECHANICALLY ENGINEERED LIFTING DEVICE; A DEVICE FOR LIFTING AWKWARD AND HEAVY LOADS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of transportation and more specifically to a machine and process for a personal, side mounted biomechanically engineered lifting device; a means of lifting awkward and heavy loads easily and safely.

The rise of human civilization can be attributed, in part, to humankind's ability to transport food, materials and manufactured items significant distances. In the distant past, before the domestication of beasts of burden, this was done with human muscle power alone. The historical record depicts that ancient peoples used simple devices to augment the power of their muscles in order to create monuments of surprising scale. It is generally agreed, for example, that the ancient Egyptians created the pyramids without recourse to the wheel or power provided by beasts of burden. The ancients used human muscles applied to very simple devices to move very large loads. Levers, log poles, rollers, multitudes of people pulling on ropes were among some of the simple tools ancient people used to help multiply the force of their muscles.

Today, even though human beings now use elaborate and expensive machines to lift and transport things there is still an essential need for human beings to lift and transport things short distances with the power of human muscles. Often, loads people carry with their bodies are heavy and the lifting situation is so awkwardly configured that people incur serious injury. Torn muscles, back pain and worse are often the consequence of trying to lift and carry loads carelessly.

The nature and scope of this problem is dramatically illustrated by simply walking through a store selling building supplies. There, on racks, are found sheets of plywood, drywall, cement blocks, doors complete with frames as well as other heavy and awkward construction items. The home handyman or the lone tradesman may get help from store personnel in order to load their car or truck, but they are on their own after they reach home or the construction site. Hand trucks, wheel barrows are very useful but these devices are often limited by rough ground or the need to go up or down stairs.

All too often, the best way to carry construction materials over rough ground and up stairs is to bend down, pick up the load, and walk off with it, stooping down again to deposit the item at its final destination. Pulled muscles and strained backs or even more serious injuries are not unusual for people engaged in this kind of activity. The problem is so common for people that it is probable that no-one in their lifetime has escaped hurting themselves through activities like this. As a consequence there is a need for methods to allow people to carry heavy loads easily, quickly and safely.

One such device (U.S. Pat. No. 6,508,389, Ripoyla et al) shows a strap, harness system designed to allow two men to support a load that is attached so that it hangs between them by straps. The two men face each other. One of the advantages of the system is that it minimizes bending and stooping but it also requires two men who balance the load between them. When used by one person the load hangs in front of the person, pulls them forward and makes walking difficult.

Dennis D. Goodden, U.S. Pat. No. 4,280,645, Jul. 28, 1981 has invented an device that utilizes a rigid "body harness" with platform hand supports to take the stress out of lifting heavy loads. Utilized by one person, the load here is applied to the front, as rigid arm supports are slid under a load prepositioned on a suitable surface. A load carried this way seriously unbalances a person. It is also difficult to bend down and pick up a heavy load and, once supported, the load is not very stable since it may easily slip off the hand platforms.

A. P. Seltzer et al, U.S. Pat. No. 3,181,752, May 27, 1964 describes a device that can be used to carry suitcases without using one's hands. It consists of a harness strapped about the upper part of a person's body with two appendages hanging down on both sides of the user's body. These appendages hang down from the shoulders and are designed to be attached to suitcases and other kinds of personal baggage. The harness is used to spread out the weight of the load throughout the user's upper body. The dimensions of the load this device can carry is very limited. Attaching the suitcases to the lifting appendages is awkward and time consuming and the user's arms must be held out from the body to avoid them bumping them into either the lifting appendages or the load. Since the suitcases are directly attached to appendages hanging down from a position under the users arms they tend to rub and bump against the lifters body and legs. Also, the lifter's hands are not directly available to manipulate the load. Most importantly, to deposit the load anywhere but on the ground, the user must stop, unhook the suitcases and then transfer them to hand-held means. The loads must be limited to rather small compact loads, like suitcases.

Ripoyla, et al, has a better approach to the problem caused when a person has to bend to lift a load. Walking can be awkward with this device, however. The operators are limited to walking sideways like a crab, or, alternatively, one forward and one backward, the load hanging between them. Ripoyla, et al, stipulates that one person can use the system but it is evident that the effectiveness of the method drops off significantly with only one operator. Without another person to balance against, the load operator must lean back to support the load and walking then becomes very difficult. The load must somehow be supported relatively high up on the body of the person lifting, otherwise it bangs into the legs and chest of the lifter if they try to walk forward. A "sledge-like" attachment is described to address this issue. One must conclude that lifting effectiveness and mobility is much impaired with one operator.

The mobility of prior systems is extremely limited. Placing the load in front requires that it be carried quite high for the user to walk forward. On the other hand, the advantage of having two lifters is significant in lifting really heavy loads like refrigerators. None of the methods address the problems involved when one person must stoop or bend to pick up heavy loads. The heavier the load, the more physical strength is needed and the greater the risk for injury. None of the systems address physical stress and strain caused by the user having to accommodate and manipulate a very heavy load applied high up on their body. It is apparent that a need exists to allow a single user to pickup and carry loads safely and easily.

BRIEF SUMMARY OF THE INVENTION

The primary advantage of the invention is to provide a practical method of lifting heavy loads attached to the side of one lifter.

Another advantage of the invention is to provide a practical method for one person to lifting awkwardly configured loads.

Yet another advantage of the system is that it allows one hand to lift and guide the load leaving the other free to open doors, to turn lights on and off as well as other necessary actions.

Another advantage of the system is that it allows the lifter to comfortably secure the load as the lifter moves about.

A further advantage of the invention is to provide a method of carrying heavy loads that places minimal stress on the body of a person lifting a heavy load.

Yet another advantage of the invention is to provide a method of carrying heavy, large and/or awkward loads so that the mass of the load acts below the operator's center of gravity.

Another advantage of the invention is to provide a method of lifting and transporting awkwardly-sized and heavy loads that is economical.

A further advantage of the invention is to provide a method of lifting and transporting awkwardly-sized and heavy loads that is compact and easily stored.

Yet another advantage of the invention is to provide a simple and safe method of carrying large panels by hand.

Another advantage of the invention is to provide a method of carrying heavy, loose, hard to bundle, multiple objects.

Another advantage of the invention is to provide a method of carrying heavy, large and/or awkward loads without damaging the object being carried.

A further advantage of the invention is to provide a method of carrying heavy, large and/or awkward loads in a manner that does not interfere with walking.

Yet another advantage of this invention is to allow a number of lifters to apply their efforts to a single large load.

Another advantage of the invention is that it includes an auto-tensioning device so that the load strap does not have to be adjusted by hand.

A further advantage of the invention is that the auto-tensioning device, used to adjust the load strap, may hang free, load strap retracted,stored to be carried by the user until it is needed again to lift something.

Yet another advantage of the invention is that accessories may be freely and easily combined with it for specific applications.

Other objects and advantages of the present invention will become apparent from the following descriptions, taken in connection with the accompanying drawings, wherein, by way of illustration and example, an embodiment of the present invention is disclosed.

This invention relates to methods single human beings use to lift and transport heavy loads. In accordance with the first preferred embodiment of the invention, there is disclosed a manual lifting device comprising: A side-mounted lifting harness with a shoulder pad means that crosses the body diagonally. A means of adjustably attaching a load strap is located at the side of the lifter at or below their waist. The load strap at or near its middle is adjustably connected to a load that, before lifting, is resting on the ground, the other end supported by the user's hand.

In accordance with another embodiment of the invention, there is disclosed a process for a load strap with a handle which is used by the lifter to carry part of the weight of the load. The load strap tension is adjustable manually where it contacts the support harness or with a hand-held auto-tensioning device at the other end of the strap built into the lifting handle.

To operate the system the person doing the lifting first bends their knees and tightens the load strap manually or by use of an auto-tensioning handle. Then, straightening their knees, keeping their back straight and leaning their body slightly away from the load, the person doing the work lifts the load some minimal distance off the ground. This should be a distance only high enough to keep the load from contacting the ground as the user walks forward. The effort to lift the load is significantly minimized because of the short distance the load is lifted and the fact that the lifter's knees, not their back are doing the lifting.

This biomechanically engineered means concentrates the mass of the load close to the ground creating an extremely stable configuration for the user to move back and forward in space. At rest, the combined center of gravity of both the lifter and the load are centered along a vertical line pass between the lifter's feet. This stable configuration, combined with the low center of gravity of the load, make it surprisingly easy for the lifter to walk forward.

Provision is made for a panel lifting frame to support large awkward loads like doors, drywall and plywood, a utility frame for loads consisting of discrete multiple objects, a utility bag-net accessory for loads comprised of smaller, multiple objects and a universal carrier that allows heavy loads like television sets, boxes of books or other heavy, hard-to-grip objects to be securely supported as they are lifted.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
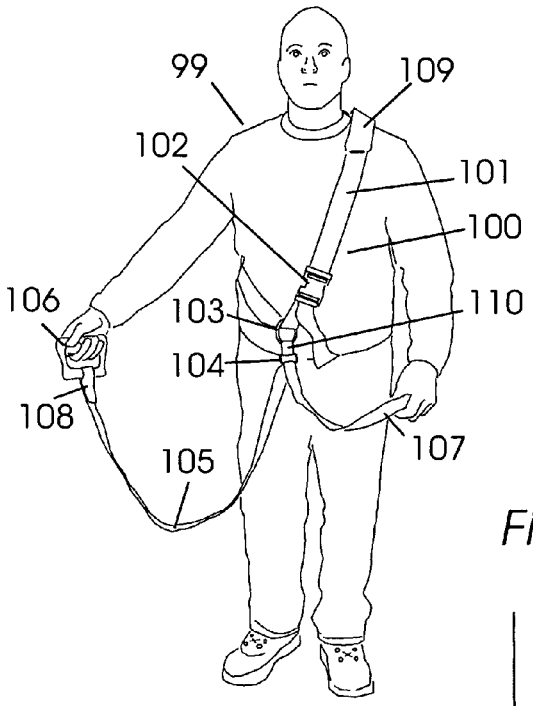
FIG. 1. Front view showing manually adjusted load strap.

In accordance with the present invention, a side-mounted biomechanical lifting harness 100 is shown fitted to a person 99 about to lift a load. The shoulder load harness means 101 shown in FIG. 1, crosses the user's body diagonally and is connected by an adjustable harness buckle connector means 102. The load harness is adjusted so that the harness-load support means 103 supports the load height adjustment strap 110 and the load support ring 104 at or below the user's waist. The load height adjustment strap 110 is designed to allow the load support means 103 to be lowered to some point below the use's waist. It is understood that all strap connections are made in accordance to standards known to those versed in the art. A shoulder harness pad means 109, attached to or integral with, is shown attached to the harness. Not shown, these strap connections can consist of sewn joints, riveted connections or heat-sealed welds as well as other methods.

Another embodiment of this invention would be comprised of a belt means around the waist with a side-mounted load support means 103. Additionally, it is the intent of this invention to utilize existing support means found on the utility belts commonly worn by carpenters, electricians, plumbers and other workmen.

The load strap free of tension 105 passes through load support means 104. In the first embodiment of the invention the person using the lifting device uses this end of the load strap 105 to make adjustments in the tension of the load strap 105. The load strap handle 106 is held in the user's hand, 108 shows some connection means of the load strap 105 to the load strap handle. In the first embodiment of the invention the load is placed or attached to the load strap 105 somewhere between the support means 104 and the load strap handle 106. To lift a load, not shown, the user bends their knees (keeping their back straight) and adjusts the load strap 105 so that it is in tension. Then, by straightening their knees and lifting up on the handle 106, the user lifts the load off the ground and is then free to transport and manipulate the load in any direction.

Figure 2:
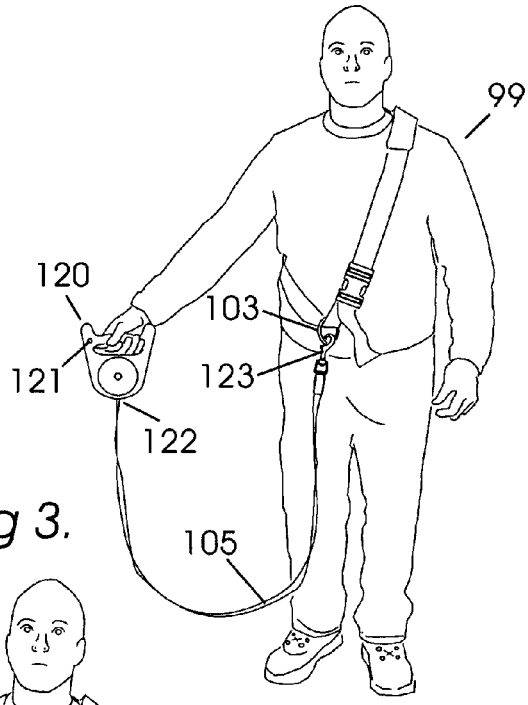
FIG. 2. Front view showing auto-tensioner adjustment of load strap.
Figure 6:
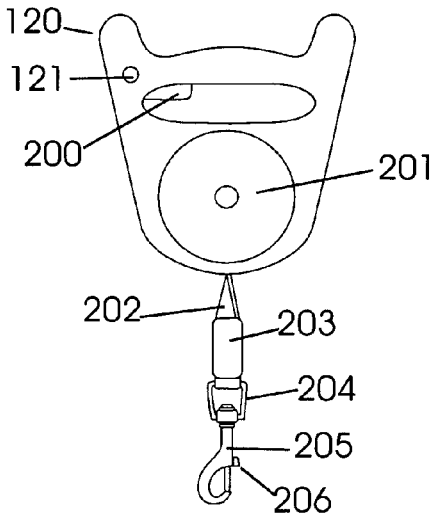
FIG. 6. Auto-tensioning lifting handle.

FIG. 2 shows another embodiment of the invention that allows a quicker and more convenient method of adjusting the load strap. The handle, grasped by the person 99 doing the lifting, in this embodiment of the invention, is comprised of an auto-tensioner means 120 and the other end of the strap is connected to the harness load support means 102 with a snap swiveling means 123. The auto-tensioner has a load lock 121 and a spool trigger lock 200 (FIG. 6). The load is positioned on the load strap 105 between the snap swiveling means 123 and the auto-tensioning handle means 120. Releasing the spool trigger lock 200 on the handle causes slack in the load strap 105 to be taken up through the auto-tensioner strap outlet 122. Engaging the lock release 121 ensures that the auto-tension cannot be accidentally released.

To lift a load, not shown, the user bends their knees (keeping their back straight) and pulls and releases the trigger on the auto-tensioner. This automatic return on the auto-tensioner 120 pulls the load strap 105 snugly about the load. Once the load strap, 105 is adjusted correctly, the spool trigger lock 200 is engaged again and held, while the load strap 105 is in tension. This holds the load strap 105 stable and in tension. The release lock 121 mechanism should then be engaged to lock the auto-tensioner. This keeps the load strap 105 from accidentally unwinding. Then, by straightening their knees and pulling up on the auto-tensioner handle 120, the user lifts the load off the ground. The user is then free to transport and manipulate the load in any direction.

Figure 3:
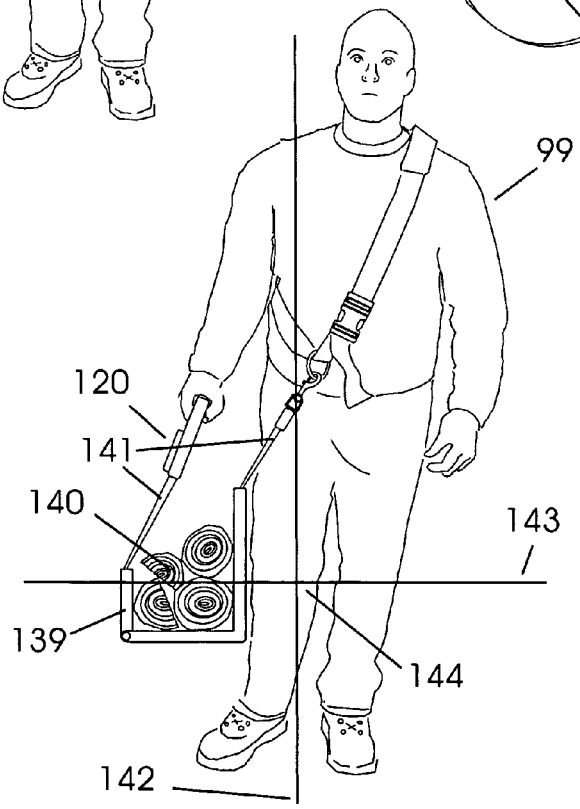
FIG. 3. Effects of a load of wood on user's center of gravity.

The biomechanical aspect of the lifting harness is shown in FIG. 3. The side mounted lifting harness is fitted to a person 99 carrying a load of firewood 140 in utility carrier accessory 139. In this drawing the auto-tensioning handle 120 is shown locked, the load strap is under tension 141 and it supports the utility carrier 139. (FIGS. 11-16 show details of the utility carrier 139.) The person 99 lifting the load is shown leaning slightly away from the load so that now the center of gravity of the system comprised of the firewood 140 and the mass of the user's body 145 can be found somewhere along a line 142. The weight of the load of firewood 140 can be said to be acting somewhere along line 143. The mass of the system, the firewood 140 and the user 99, can be thought of as acting at a point somewhere near the intersection of lines 142 and 143 at point 144. The user feels tension in the auto-tensioner handle 120 but more significantly, at rest, the weight of the load will appear to be acting somewhere between the user's knees, on line 142 extending to between the user's two feet. This is a very comfortable, stable way to carry a weight. By using their knees and not their back, the user minimizes strain to their back.

Figure 4:
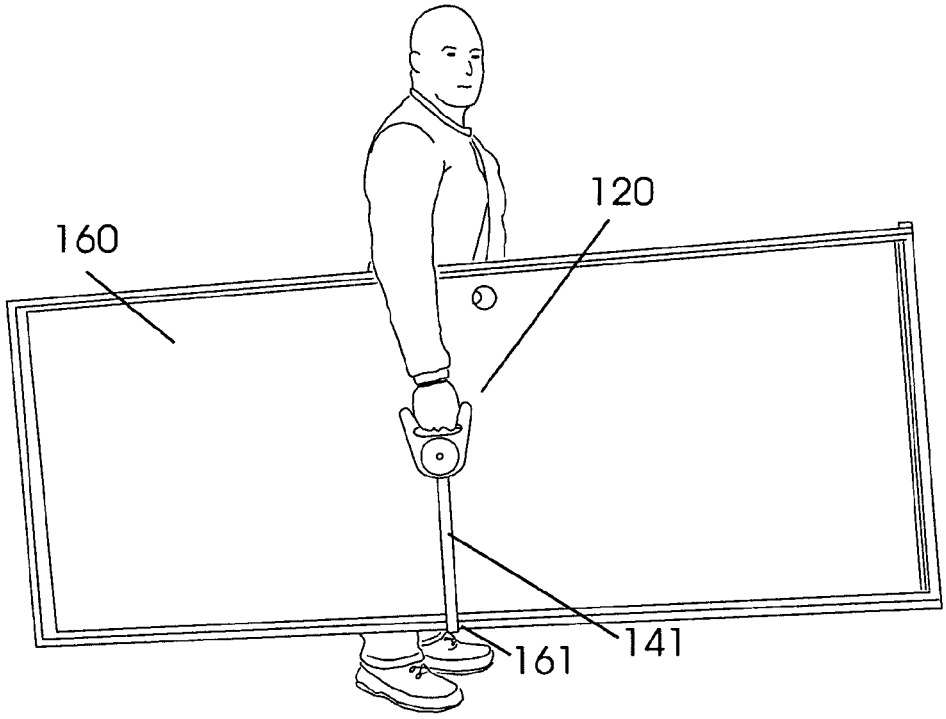
FIG. 4. Method used to carry door.

Large and awkward loads are carried very efficiently with this method. FIG. 4 shows a person lifting and carrying a door 160 with its frame. The auto-tensioner 120 is secured by the user's hand, the door 160 supported by the load strap in tension 141. The tensioned load strap 141 passes under the door at point 160. The door 160 is carried between the lifter's arm and their body. This is a method applicable to plywood, drywall and other large and cumbersome loads like rolled rugs, furniture, heavy beams and television sets among other things. It is convenient, with this method, to carry things up stairs (the door may be tilted by the user on the way up) and to open doors with the user's free hand.

The load strap 105 may be used with containers of liquid (gas cans and water containers for example) by passing it through pre-existing handles on the container since the method does not depend upon the strap going under the load. It is understood, by those knowledgeable in the art, that the lifting harness may be used by more than one person on some kinds of loads. A very heavy and long beam or even a rug, for example, might be carried by a number of lifters, each applying their biomechanical, side-mounted lifting harness sequentially to the load.

Figure 5:
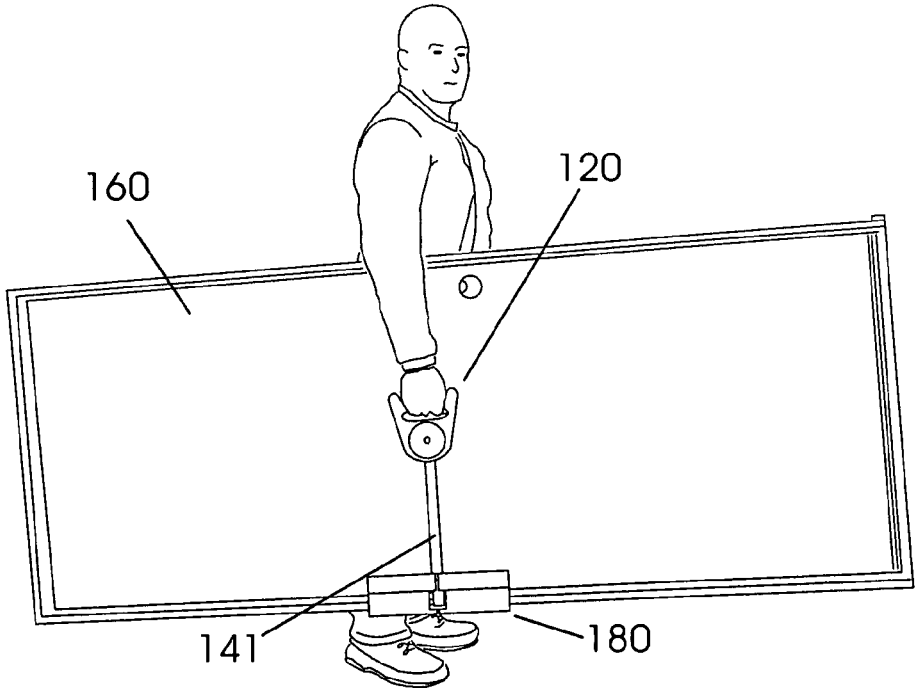
FIG. 5. Panel frame lifting accessory used to carry door.

FIG. 5 shows the side-mounted lifting device used to lift a door using the panel frame attachment 180. The panel frame attachment 180 is a device that allows heavy and rather delicate loads, like dry wall, for example to be lifted without damaging the material. The lifting force is transferred from the narrow cross section of the lifting strap 141 to the broad secure surface of the panel frame lifting attachment 180. The panel frame lifting attachment is comprised of a frame through which the load strap 141 passes in such a way that the panel frame attachment 180 is securely drawn against the bottom of the load. Other advantages of the panel frame attachment 180 include stabilizing the load, reducing load strap 141 slippage and a more secure "grip" when the side-mounted lifting device is used to carry multiple loads such as several panels at a time, for example.

The body 120 of the auto-tensioner is illustrated in FIG. 6. The auto-tensioner in its open position allows the load strap 105 to freely spool in and out. The coiled tension strap cover 201 allows space for the load strap 105 to coil and uncoil as needed. The load strap 105 is shown as a dangling free load strap 202 in FIG. 6. When tension is applied to the free load strap 202 and the spool lock trigger 200 is pulled the free load strap 202 becomes locked and it ceases to unwind as long as there is tension on it. Releasing the tension on the fee load strap 202 causes the auto-tensioner 120 to automatically default to the unlocked position and the load strap is free to unwind or retract if there is no tension on it. If there is a load on the free load strap 202 and the spool lock trigger has been engaged, pushing the auto-tensioner lock button 121 will cause the auto-tensioner spool lock trigger 200 to become securely locked. In this case the free load strap 202 will not spool in or out even if it is relieved of tension. This is a safety feature designed to prevent accidental spool lock trigger 200 release which might cause the load to slip. The auto-tensioner lock button means must be pressed a second time before the spool lock trigger means 200 can be unlocked to free the load strap 105.

The free load strap in FIG. 6 is shown attached to a load strap stop 203 which blocks and stops the re-winding of the load strap when it has reached the end range of its usable length. The free load strap 202 and the load strap stop 203 are shown connected with suitable means to the swivel turn-buckle component 204 on the snap-swivel component body 205. The snap-swivel component actuator guide 206 is used to open and close snap-swivel body 205.

Figure 7:
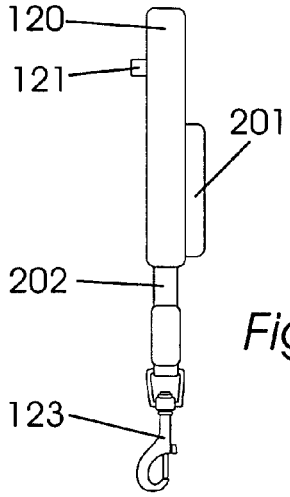
FIG. 7. Side view of auto-tensioning lifting handle.

A side view of the auto-tensioner is illustrated in FIG. 7. The body of the auto-tensioner is indicated by 120, the auto-tensioner lock button 121 is shown and the coiled tension strap cover 201. Free load strap 202 is shown connected to snap-swivel means 221.

Figure 8:
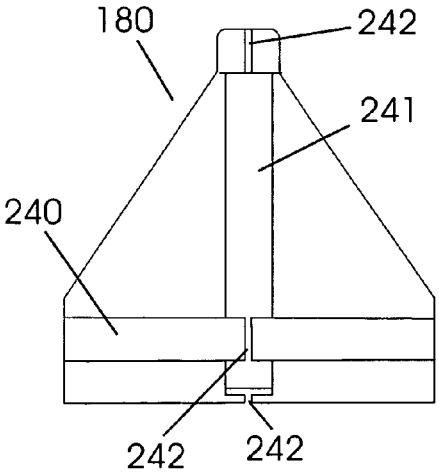
FIG. 8. Back view of panel frame accessory.
Figure 11:
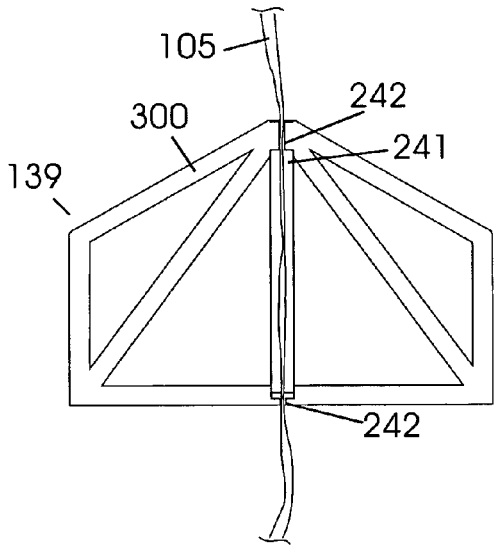
FIG. 11. Back view of utility carrier, method of inserting load strap into access slots.
Figure 12:
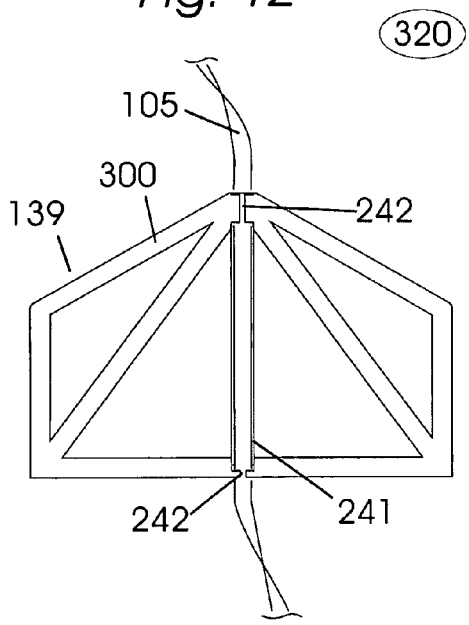
FIG. 12 Back view of utility, load strap fully inserted.

The back view of the panel frame accessory 180 is shown in FIG. 8. Re-enforcing strips 240, defining the load strap access slots 242, cross both the back, front and bottom of the panel frame accessory 180. The load strap access slots 242 permit the load strap 105 to be installed on the panel frame accessory 180 without having to detach the load strap 105 from the harness load support ring 103 in order to thread it tediously through securing means on the panel frame accessory 180. The load strap 105 (not shown) slides in a recessed strip 241 that runs along the sides of the panel frame accessory 180 front, back and bottom. The load strap is inserted and held secure in this slot by means of load strap access slots 242. (FIGS. 11-12 show the mechanism the load strap is inserted in the load strap access slots 242.) Three insertion slots 242 are visible from the back view of the panel frame accessory 180; two, vertical on the back, and a side view of one on the bottom, back of the panel frame accessory 180.

Figure 10:
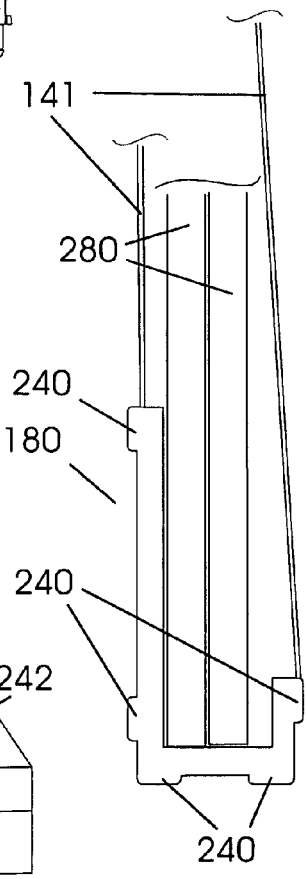
FIG. 10. Side view of panel frame accessory loaded with two panels.
Figure 9:
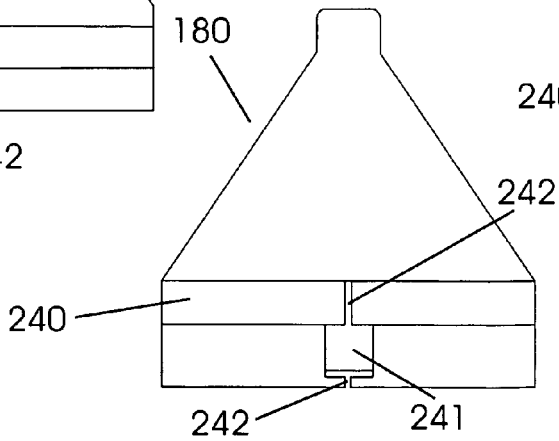
FIG. 9. Front view of panel frame accessory.

The top front and bottom front load strap access slots 242 are shown in the front view of the panel frame lifter 180, FIG. 9. The recessed strip 241 is visible on the front face of the panel frame lifter. Not shown is the recessed strip running along the bottom of the panel frame accessory 180. A side view of the panel frame accessory 180 is shown in FIG. 10. The load strap under tension 141 pass along the recessed strips on the back side, bottom and front of the panel lifter 180 (not shown). The re-enforcing strips 240 are shown from the side. Not visible are the load strap access slots 242. There are 6 of them in this embodiment of the panel frame accessory 180, two in the back, two on the bottom and two on the front. Two panel means 280 (drywall, plywood or other) are shown secured and being lifted by the panel frame accessory 180.

FIG. 11 shows the back of the utility carrier 139 showing the method that the load strap 105 is inserted through the load strip access slots 242. (Most accessories use the same method of attaching the load strap 105 and securing it in a recessed strip where appropriate so the same identifying numbers are used on different accessories.) The recessed strip 241 is shown between the two load strap access slots on the back of utility carrier 139. The load strap 105 in FIG. 11 is shown twisted on its side being inserted through the load strap access slots 242. The access slots 242 allow for speedy attachment of the accessory. The utility carrier is shown strengthened and re-enforced with re-enforcing ribs 300.

FIG. 12 shows how the load strap 105 is laid flat, through access slots 242, in the recessed strip 241 on the back of the utility carrier 139. Back re-enforcing ribs 300 are shown. A similar method is used to secure the load strap to the bottom and front of the utility carrier 139.

Figure 13:
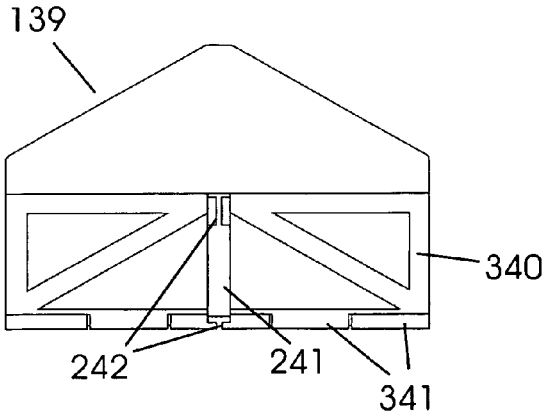
FIG. 13. Front view of utility carrier.
Figure 14:
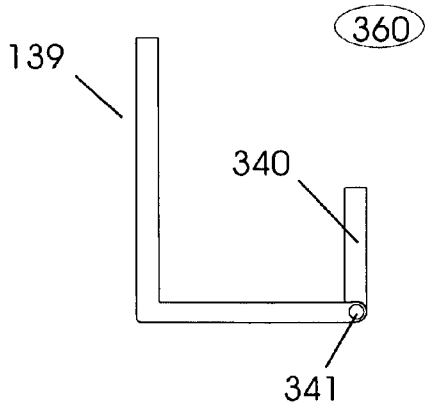
FIG. 14. Side view of utility carrier.

FIG. 13 is a front view of the utility carrier 139 showing the front panel with re-enforcing ribs 340, the hinge 341 joining the front panel to the bottom and rear section of the utility carrier 139, load strap 105 (not shown) access slots 242 and recessed strip means 241. FIG. 14 is a side view of the utility carrier 139 showing the front panel 340 and the hinge means 241 joining the front panel 340 to the body of the utility carrier 139.

Figure 15:
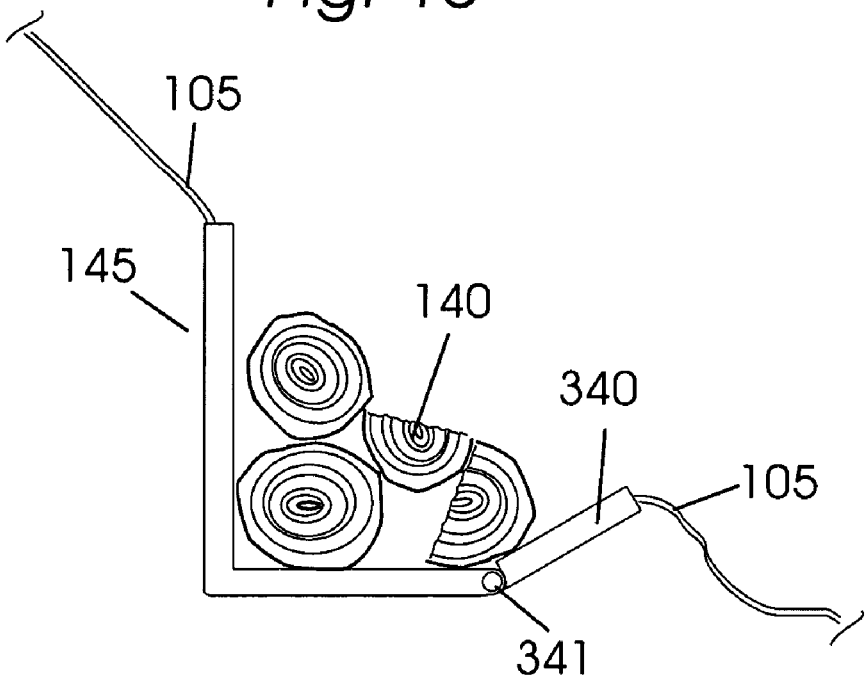
FIG. 15. Side view of utility carrier being loaded.

FIG. 15 is a side view of the utility carrier 139. The load strap free of tension 105 is shown running through the back side, bottom and front. Not shown are the load strap access slots 242 and the recessed strip 241 that runs along the back, bottom and front of utility carrier 139. A load of firewood 140 is shown loosely stacked. The hinged 341 front panel 340 is shown in an open position.

Figure 16:
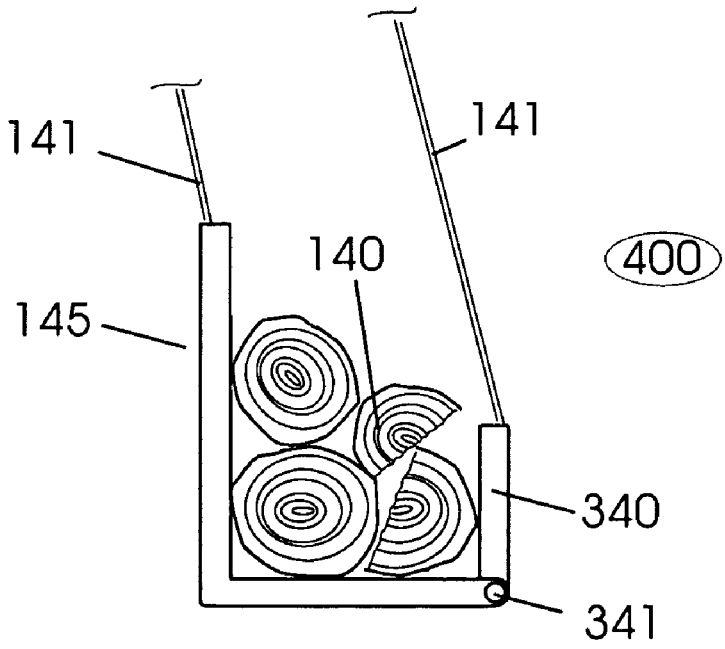
FIG. 16. Side view of utility carrier with load.

FIG. 16 is another side view of the utility carrier 139. Also shown is the same load of firewood 140. In this case, however, the load strap under tension 141 is depicted pulling the hinged 341 front panel 340 to a closed vertical position. The closing action of the front panel 340 pushed the load of firewood 140 to a compacted form. Not shown are the load strap access slots 242 and the recessed strip 241 that runs along the back, bottom and front of utility carrier 139. With the load strap under tension 141, the firewood (load) compacted by the closing action of the panel door 340, the load is ready to be lifted. The person using the biomechanical lifting harness 100 bends at the knees and adjusts the load strap under tension 141. Then keeping their back straight, the person 99 lifting the load straightens their knees to lift the load a distance off the ground. That distance determined by the height of any obstacles along the path to be traversed. One hand is used to support the load, the other is free to open doors, turn on light switches and perform other necessary tasks. The load may be easily and safely transported using this means.

Figure 17:
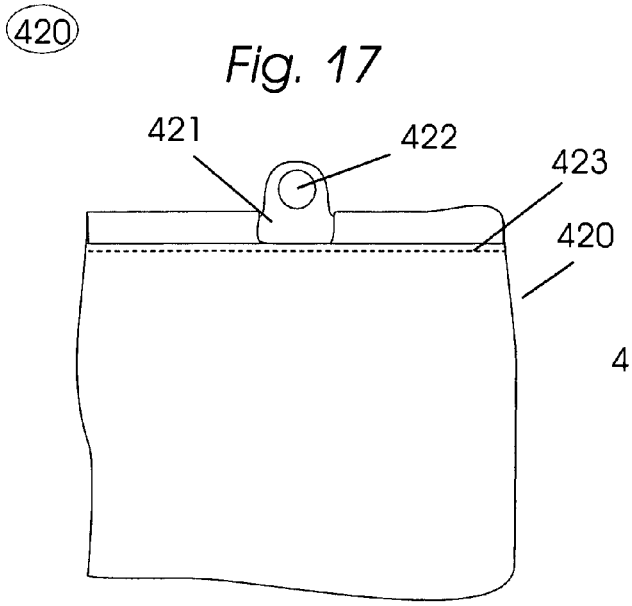
FIG. 17. Front view of utility bag.
Figure 18:
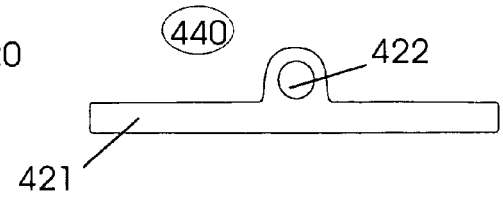
FIG. 18. Utility bag insert.
Figure 19:
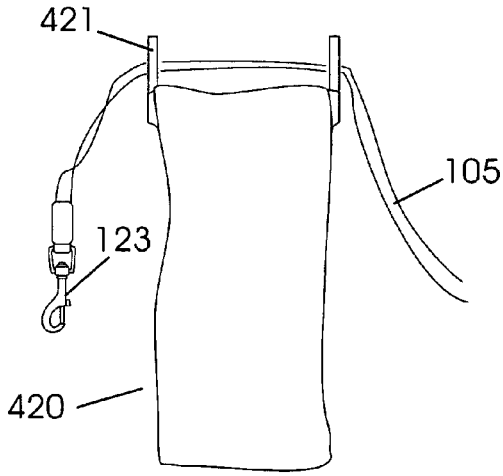
FIG. 19. Utility bag from side.
Figure 20:
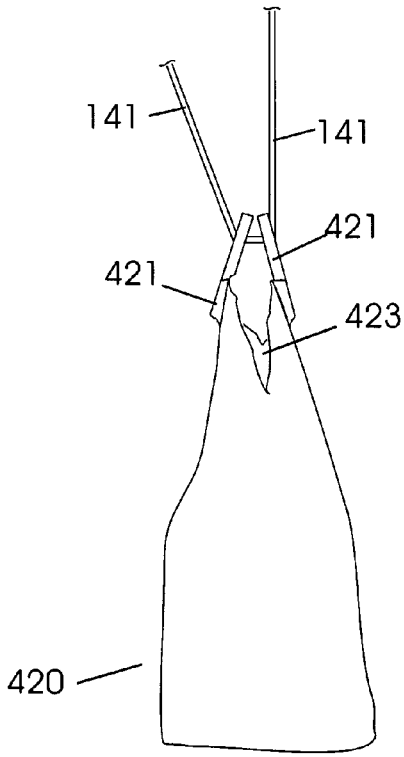
FIG. 20. Utility bag from side under tension.

A front view of the utility bag 420 is shown in FIG. 17. The rigid insert 421 with an aperture 422 is shown sewn in place on the page by seam 423. The rigid insert with aperture 422 is shown in FIG. 18. The aperture may be large enough so that either end of the load strap 105 may be passed through it. Other embodiments of this device may contain a slot means, not shown, to allow the load strap 105 to be slipped into the aperture and then securely held in tension. A side view of the utility bag 421 is shown in FIG. 19. Load strap 105 with the snap-swivel 123 is shown passed through the aperture means 422 (not shown) in the rigid insert 421. FIG. 20 shows the utility bag 420 with the load strap under tension 141 passing through the aperture means 422 (not shown) and pulling the mouth 423 of the bag closed. The utility bag is intended to be used to carry small and loose objects. These could include bricks, cans, scraps of wood, as well as other loose materials. It may also be used to carry awkward and or delicate objects that either are difficult to attach to the load strap or would be damaged by it. Such loads might include electronic equipment, tools and artwork as well as other applicable loads.

With the load strap under tension 141, FIG. 20, the mouth 423 of the utility bag 420 is closed and the load is ready to be lifted. The person 99 using the biomechanical lifting harness 100 bends at the knees and adjusts the load strap under tension 141. Then keeping their back straight, the person 99 lifting the load straightens their knees to lift the utility bag a distance off the ground. That distance determined by the height of any obstacles along the path to be traversed. One hand is used to support the load, the other is free to open doors, turn on light switches and perform other necessary tasks. The load may be easily and safely transported using this means. The body of the utility bag 420 may be composed of canvas or plastic or any suitable flexible means including net or screen material.

Figure 21:
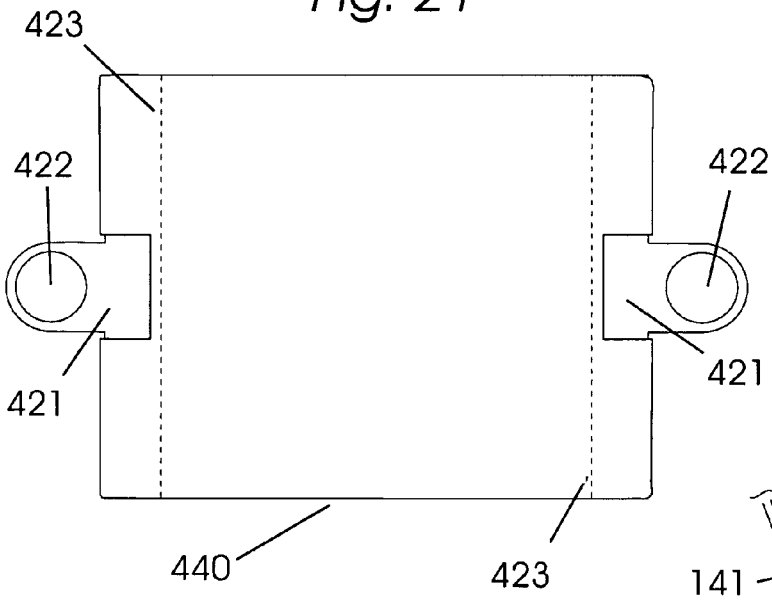
FIG. 21. Top view of the universal carrier.

FIG. 21 shows a top view of the universal carrier 440 designed to securely support awkwardly configured, delicate and other hard to support items. This would include things like television sets, computer equipment, printers, furniture, tools, equipment and supplies as well as other loads. A rigid insert 421 with aperture 422 means for the insertion of the load strap 105 is shown securely attached to the body of the universal carrier 440 with stitched seam 423 or other suitable connection means. The body of the universal carrier 440 is intended to be created of flexible means, including but not limited to, canvas, flexible plastic and woven materials. In some applications battins (not shown), parallel to the rigid insert means 421 may be inserted to provide extra strength.

Figure 22:
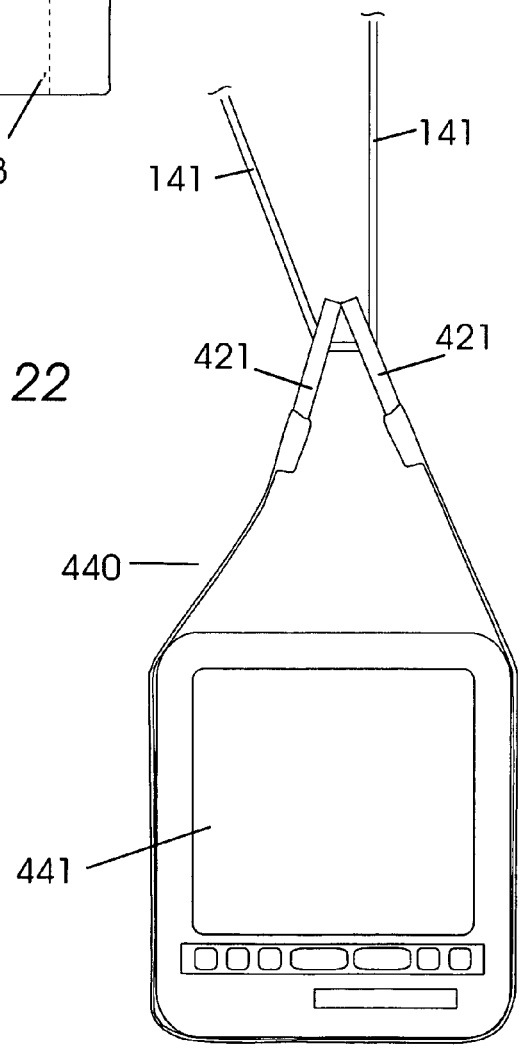
FIG. 22. Side view of the universal carrier lifting a TV.

FIG. 22 shows the universal carrier 440 being utilized to lift and carry a television set 441. The load strap in tension is shown by 141 as well as a side view of the rigid insert 421 which is penetrated by load strap 141. The body of the universal carrier 440 is shown wrapping around this delicate load, in this case a television set 441, holding it securely and safely as tension is applied to the load strap 141.

To use the universal carrier the person 99 using the biomechanical lifting harness 100 bends at the knees and adjusts the load strap under tension 141 that passes through the aperture means 422 in the rigid insert 421. Then keeping their back straight, the person 99 lifting the load straightens their knees to lift the universal carrier 440 a distance off the ground. The body of the universal carrier 440 is pulled tight about the load securely cradling it and supporting it. That distance the load is lifted off the ground is determined by the height of any obstacles along the path to be traversed. One hand is used to support the load, the other is free to open doors, turn on light switches and perform other necessary tasks. The load may be easily and safely transported using this means.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed:

1. A method for easily and safely lifting an awkward or heavy load, comprising the steps of:

(a) providing a load harness means having a load support means attached thereto;

(b) providing a load strap having a handle at a first end thereof and a snap swiveling means at a second end thereof, wherein the handle includes an auto-tensioner means such that the first end of the load strap can be selectively spooled into and out of the handle;

(c) attaching the load harness means about a user's torso;

(d) attaching the snap swiveling means to the load support means;

(e) securing a middle portion of the load strap to a load;

(f) and grasping and lifting the handle in order to lift the load for transport.

2. A method for easily and safely lifting an awkward or heavy load as set forth in claim 1 above, wherein the step of attaching the load harness means about a user's torso further includes positioning the load support means at a user's side so that the attached load strap will allow a user to carry the load at their side.

3. A method for easily and safely lifting an awkward or heavy load as set forth in claim 1 above, wherein the step of securing a middle portion of the load strap to a load further includes attaching a utility carrier accessory to the load strap.

4. A method for easily and safely lifting an awkward or heavy load as set forth in claim 1 above, wherein the utility carrier accessory is a utility bag having aperture means through which the load strap is received.

* * * * *